US010066908B2

(12) United States Patent
Hong

(10) Patent No.: US 10,066,908 B2
(45) Date of Patent: Sep. 4, 2018

(54) DART GAME DEVICE ALLOWING AUTHENTICATION USING THROW LINE IN REMOTE MULTI-MODE

(71) Applicant: HONG INTERNATIONAL CORP., Seoul (KR)

(72) Inventor: Sang Uk Hong, Seoul (KR)

(73) Assignee: HONG INTERNATIONAL CORP., Seoul (KR)

( * ) Notice: Subject to any disclaimer, the term of this patent is extended or adjusted under 35 U.S.C. 154(b) by 472 days.

(21) Appl. No.: 14/441,706

(22) PCT Filed: Nov. 5, 2013

(86) PCT No.: PCT/KR2013/009913
§ 371 (c)(1),
(2) Date: May 8, 2015

(87) PCT Pub. No.: WO2014/073827
PCT Pub. Date: May 15, 2014

(65) Prior Publication Data

US 2015/0308793 A1 Oct. 29, 2015

(30) Foreign Application Priority Data

Nov. 9, 2012 (KR) ..... 10-2012-0126836

(51) Int. Cl.
*F41J 3/02* (2006.01)
*F41J 5/04* (2006.01)
(Continued)

(52) U.S. Cl.
CPC ..... *F41J 3/02* (2013.01); *F41J 3/0009* (2013.01); *F41J 5/04* (2013.01); *F41J 5/042* (2013.01); *F41J 5/14* (2013.01); *F41J 11/02* (2013.01)

(58) Field of Classification Search
None
See application file for complete search history.

(56) References Cited

U.S. PATENT DOCUMENTS

2005/0075153 A1* 4/2005 Valero Moreno ..... G07F 17/32 463/1
2012/0024043 A1 2/2012 McBrady et al.

FOREIGN PATENT DOCUMENTS

GB 2430895 A * 4/2007 ..... F41J 3/02
JP 2006-212224 A 8/2006
(Continued)

OTHER PUBLICATIONS

International Search Report dated Feb. 7, 2014 from corresponding International Application No. PCT/KR2013/009913; 4 pages.
(Continued)

*Primary Examiner* — William C Vaughn, Jr.
*Assistant Examiner* — Joseph A Towe
(74) *Attorney, Agent, or Firm* — Maier & Maier, PLLC

(57) ABSTRACT

A dart game apparatus used to authenticate whether a counterpart player plays a dart game in a just manner in a remote multi-mode. According to an exemplary embodiment of the present invention, the present invention may disclose a dart game apparatus. The dart game apparatus includes: a throw line configured to indicate a position, at which a dart is thrown; and a touch unit extended from the throw line in an opposite direction of a dart target, in which only when a dart game player throws the dart in a state of touching the touch unit, it is authenticated that a dart game is justly performed.

12 Claims, 14 Drawing Sheets

(51) Int. Cl.

| | |
|---|---|
| ***F41J 5/14*** | (2006.01) |
| ***F41J 11/02*** | (2009.01) |
| ***F41J 3/00*** | (2006.01) |

(56) References Cited

FOREIGN PATENT DOCUMENTS

| | | | | |
|---|---|---|---|---|
| JP | 2006212224 | A | * | 8/2006 |
| KR | 10-2010-0034645 | A | | 4/2010 |
| KR | 10-2011-0001114 | A | | 1/2011 |
| KR | 10-2011-0021069 | A | | 3/2011 |

OTHER PUBLICATIONS

Office Action dated Jul. 12, 2016 from corresponding Japanese Application No. 2015-541680; 7 pages.
Office Action dated Jul. 12, 2016 from corresponding European Application No. 13852995.3; 1 page.
Chinese Office Action dated Mar. 17, 2017, including a Chinese Search Report, in connection with corresponding CN Application No. 201380058839.4 (18 pages, including English translation).

* cited by examiner

[FIG. 1]
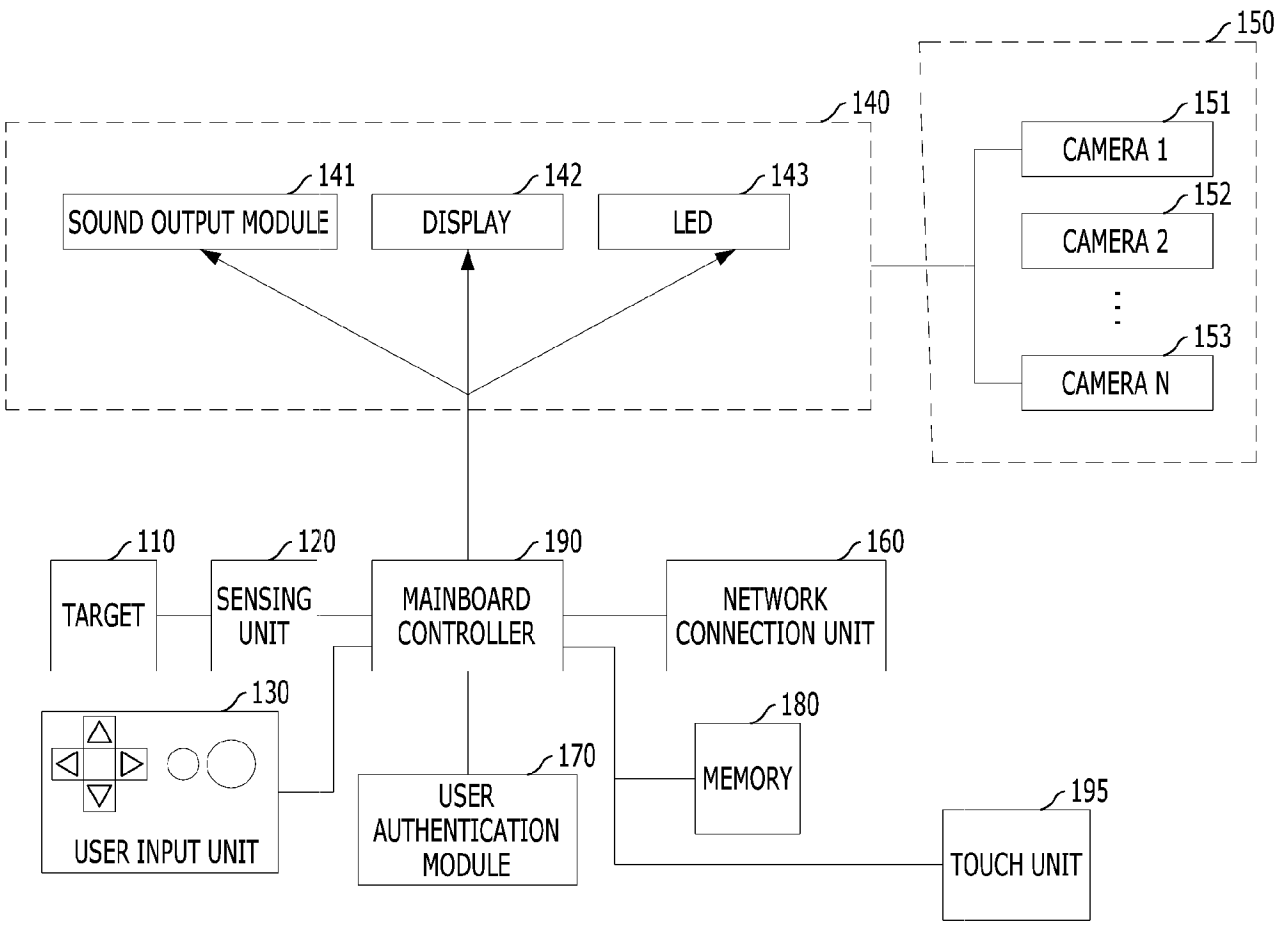

[FIG. 2]
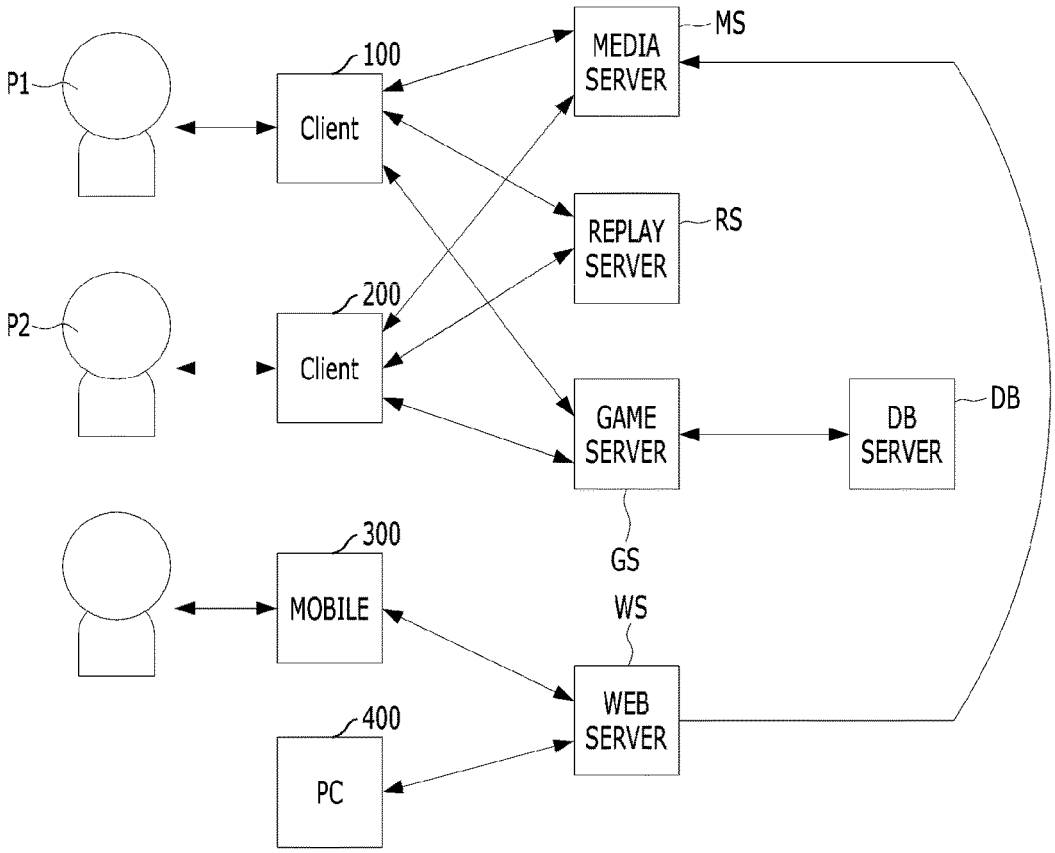

[FIG. 3]
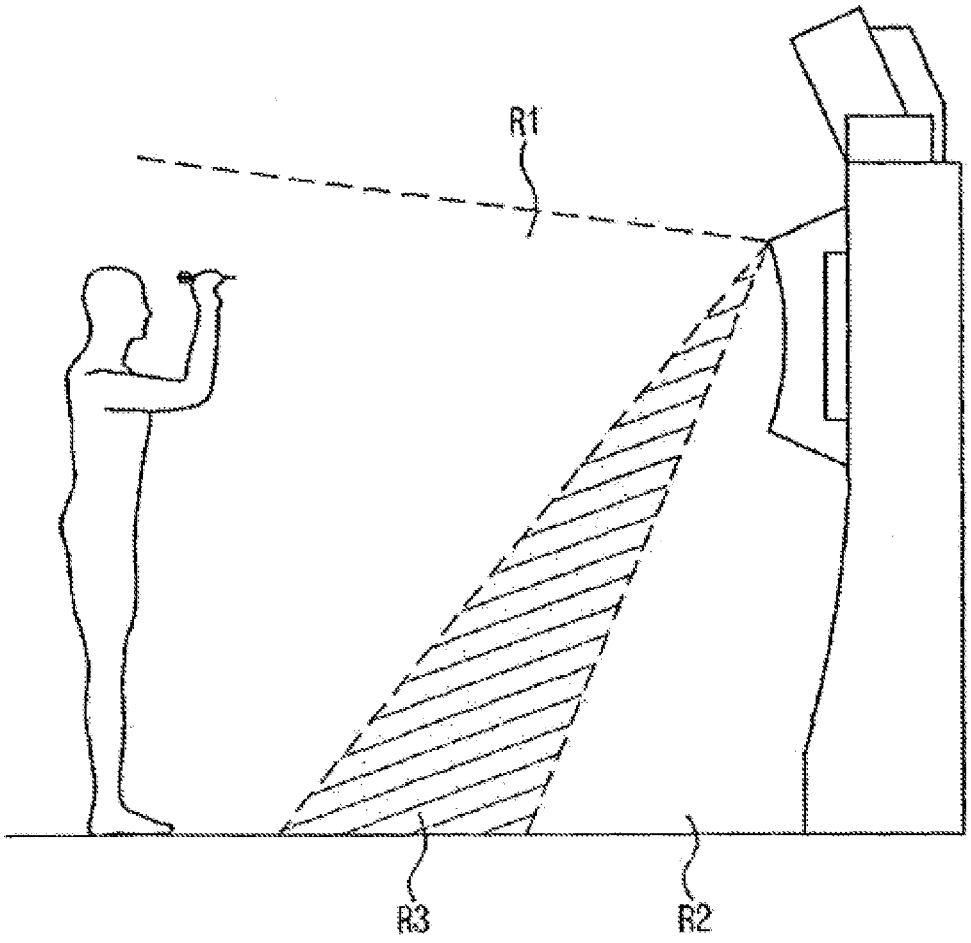

[FIG. 4]
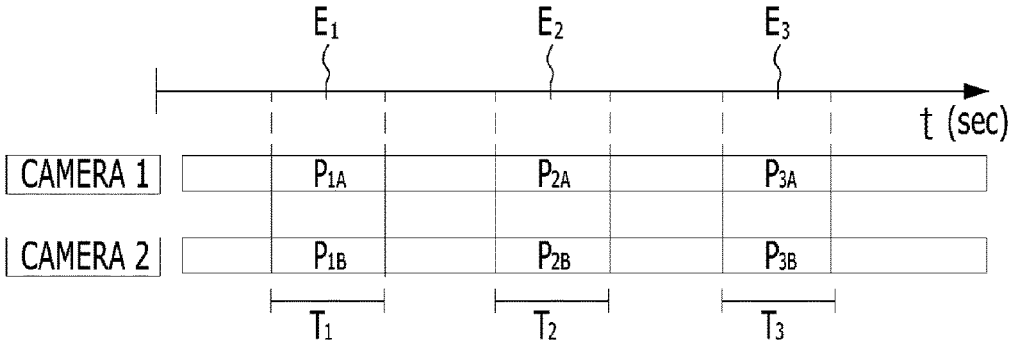
[FIG. 5]
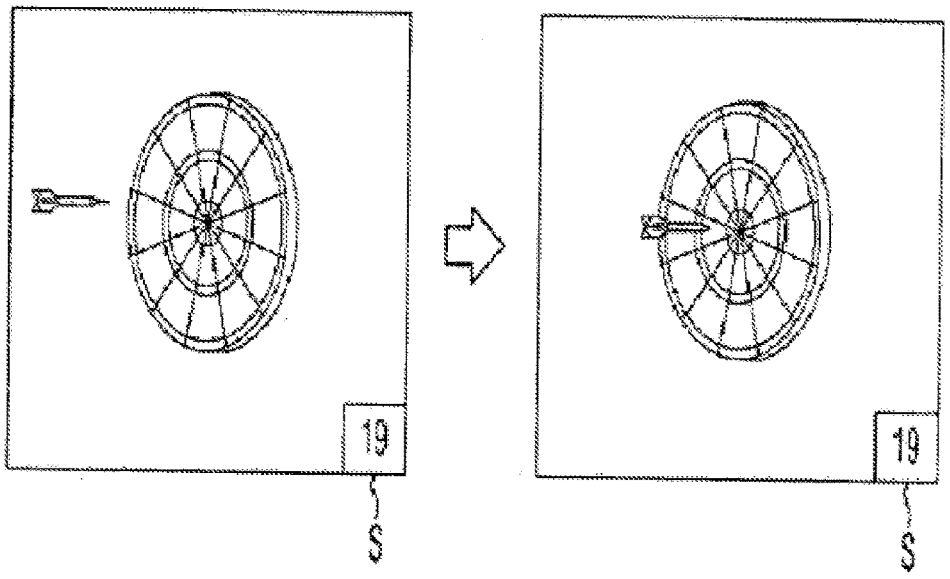

[FIG. 6]
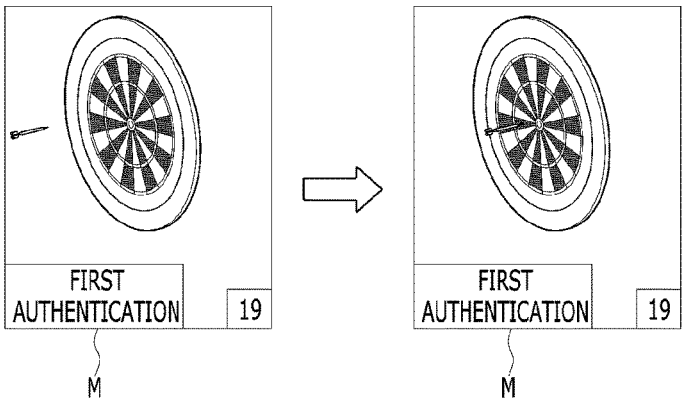
[FIG. 7]
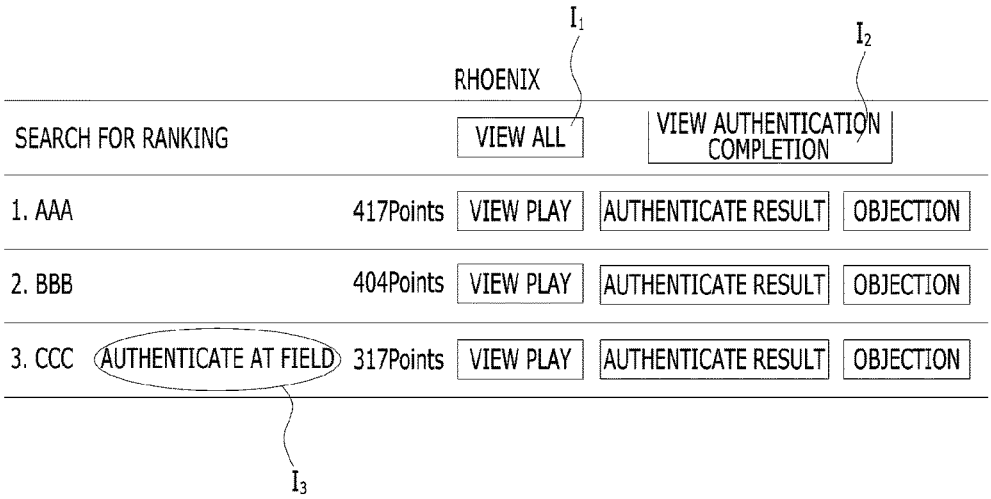

[FIG. 8]
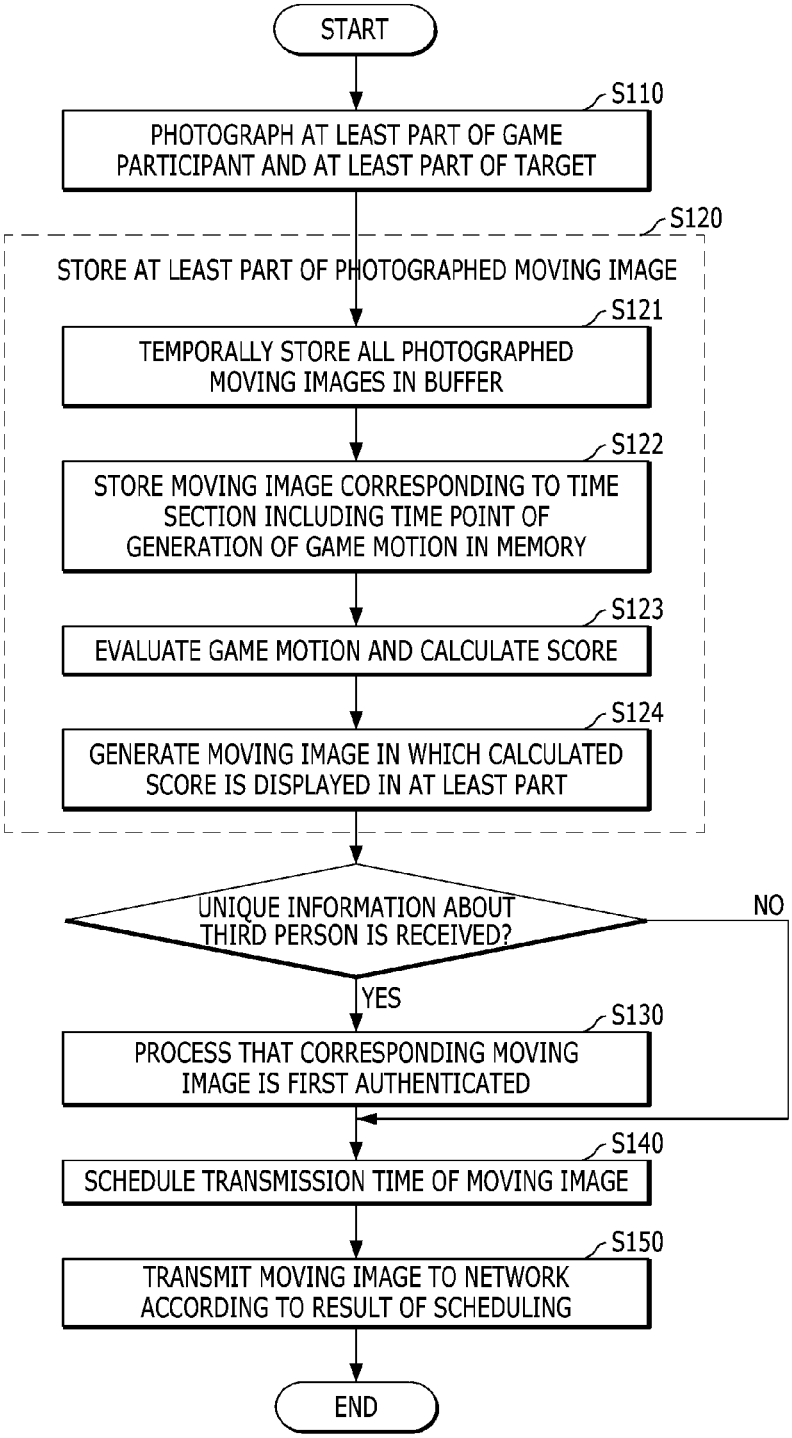

[FIG. 9]
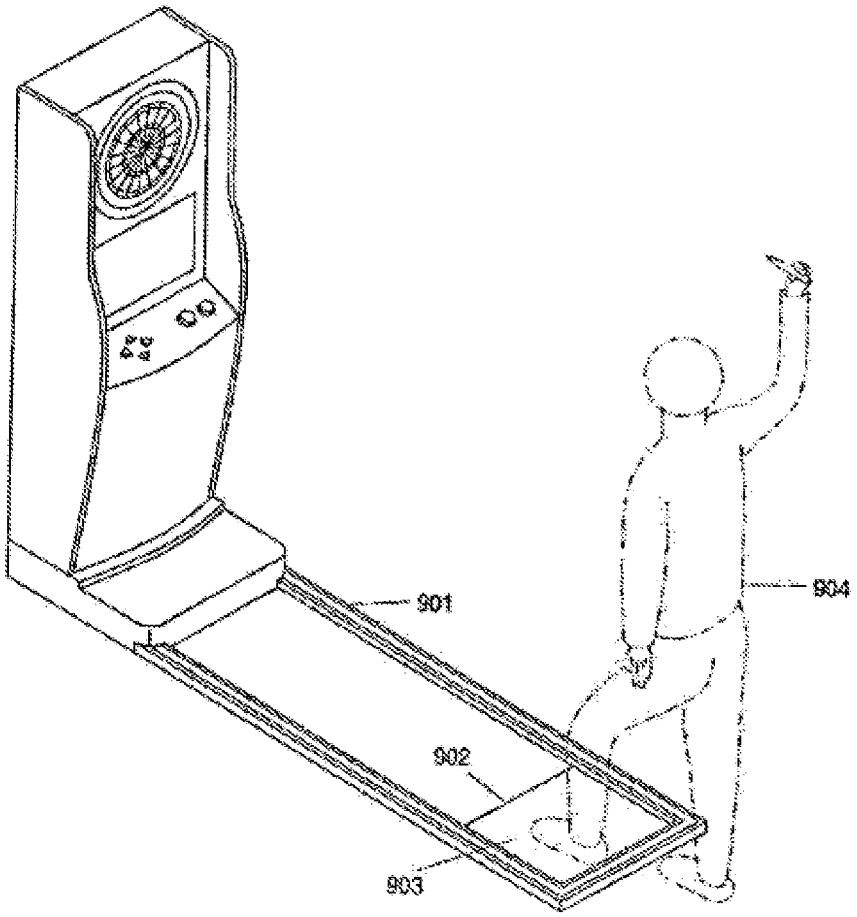

[FIG. 10]
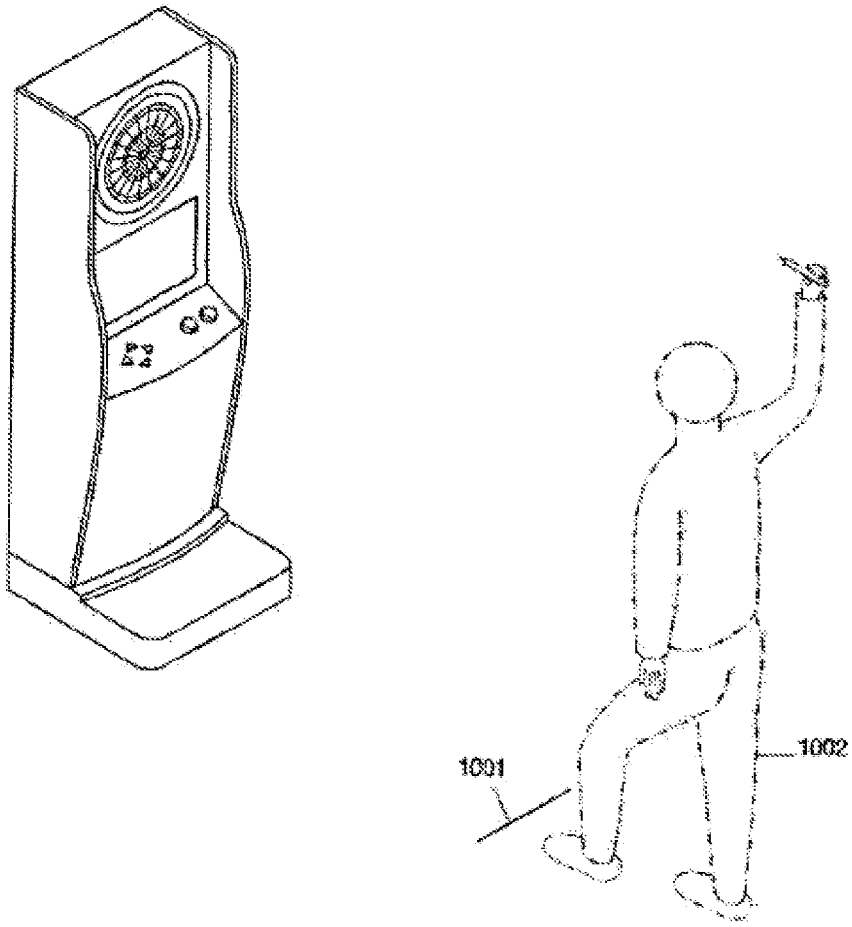

[FIG. 11]
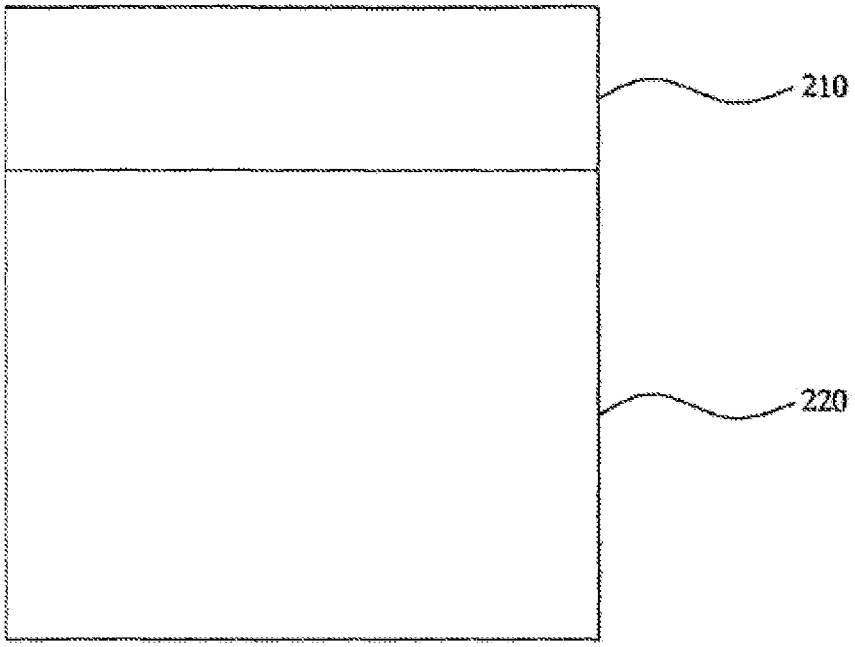

[FIG. 12]
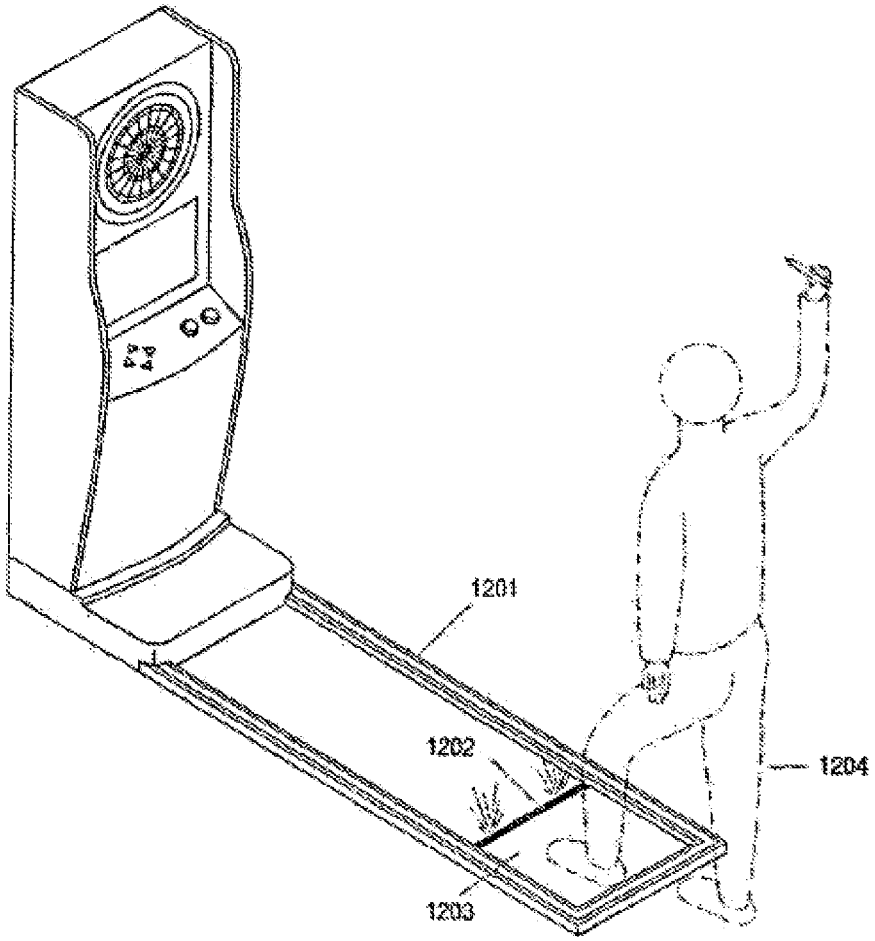

[FIG.13]
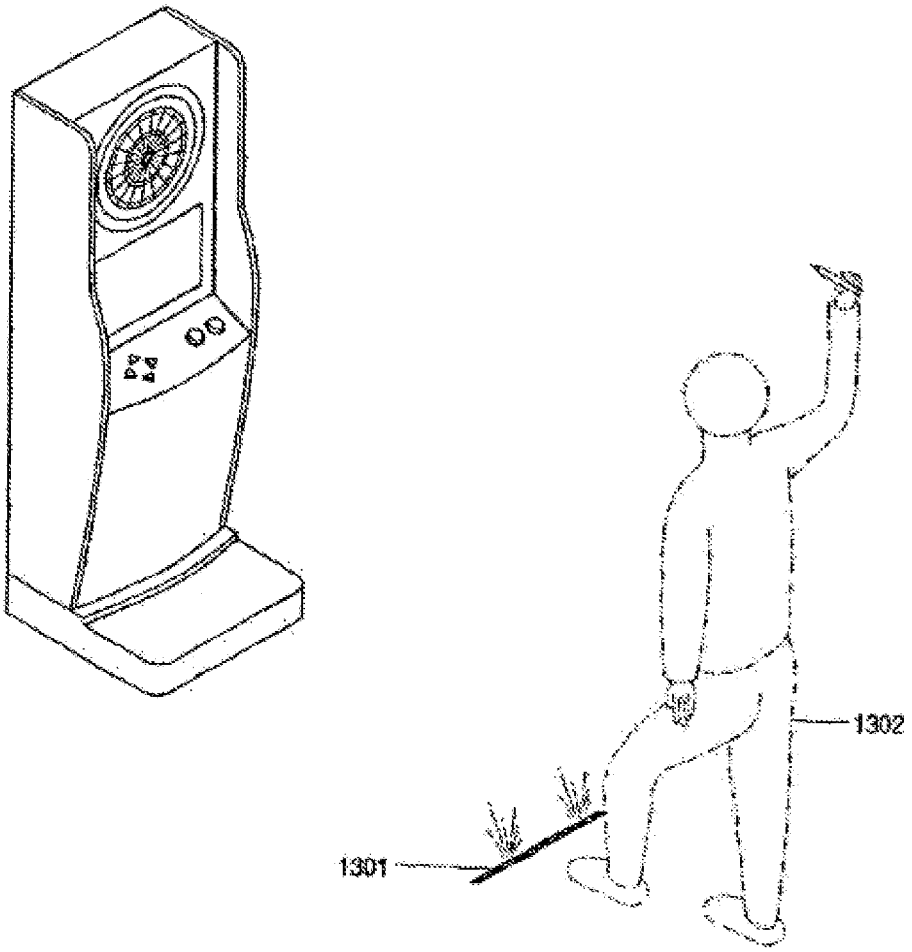

[FIG. 14]
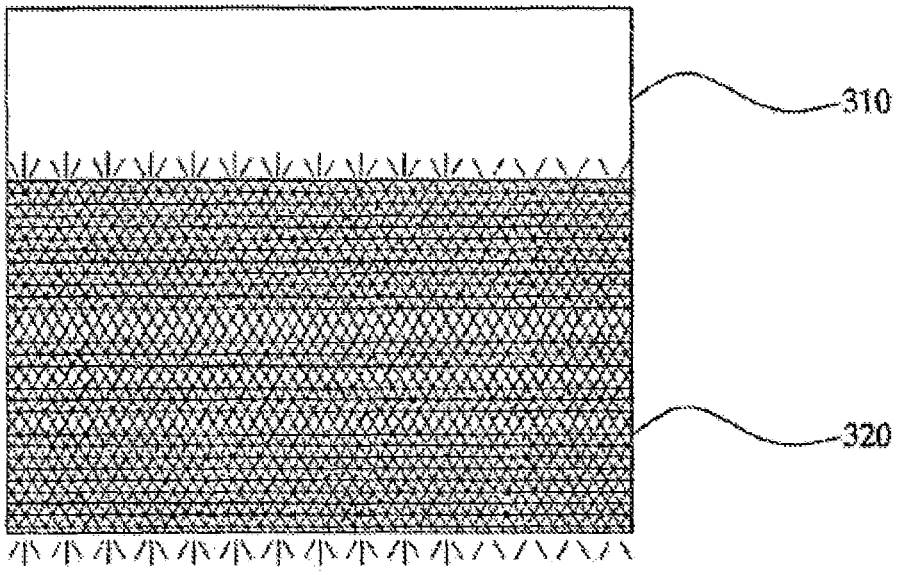

[FIG. 15]
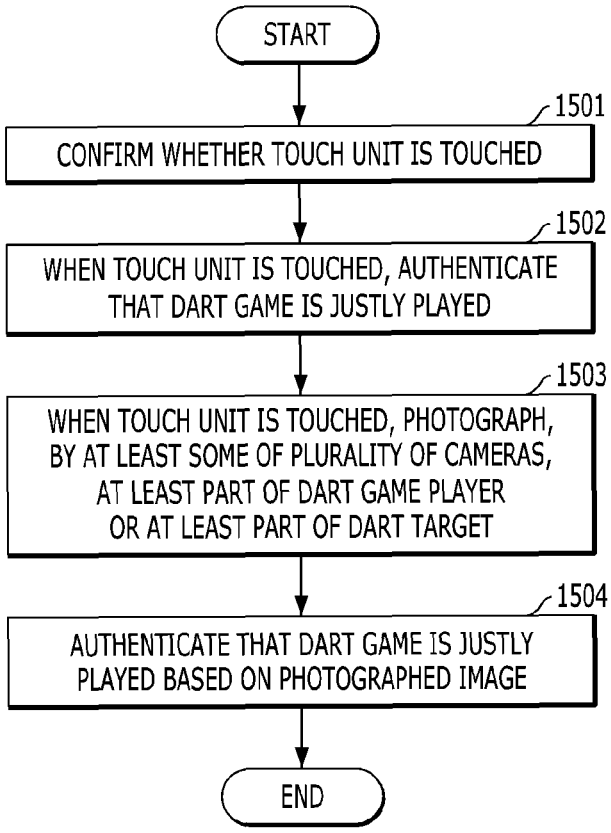

[FIG. 16]
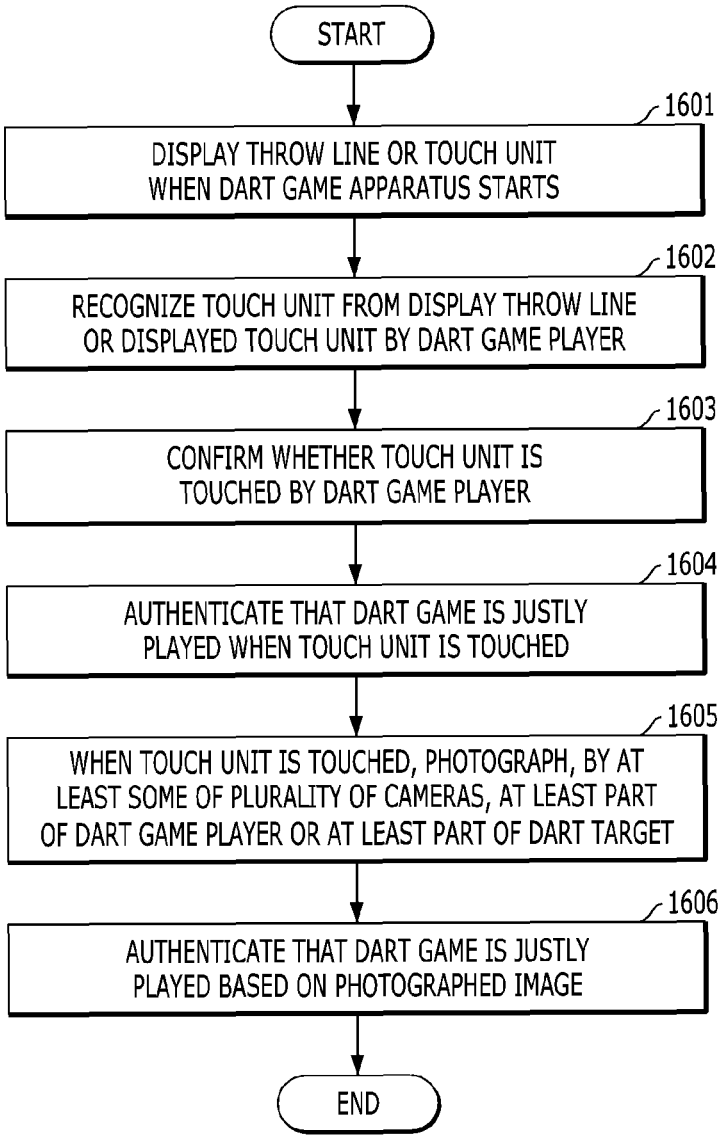

DART GAME DEVICE ALLOWING AUTHENTICATION USING THROW LINE IN REMOTE MULTI-MODE

TECHNICAL FIELD

The present invention relates to a dart game apparatus, and particularly, to a dart game apparatus, which is capable of authenticating just game participation in a remote multi-mode, in which dart game players existing at different spaces and times play a dart game

BACKGROUND ART

In general, a dart means a "small arrow", and darts is a game in which a person throws an arrow-shaped dart pin at a circular target which has numbers on it used for scoring, and a dart game has an advantage in that if there are an arrowhead-shaped dart and a dart target, anyone can enjoy the dart game anytime and anywhere regardless of weathers.

Recently, according to the development of various game manners and organization of a scoring method, the dart game has been developed as leisure sport globally, and thus men and women of all ages have conveniently enjoyed the dart game.

However, in general, participants of the dart game need to participate in the game at the same place and the same time in order to enjoy the dart game. However, according to the development of communication technology, the participants of the dart game may individually participate in the dart game at a remote location, and remotely transmit play results or play processes of the participants to a remote location through a network. Accordingly, the participants of the dart game may participate in the game beyond temporal and spatial restrictions.

When the participants of the game mutually transmit dart game play results of the participants and enjoy the dart game, for a fair dart game, a method of enabling at least a part of the participants of the dart game or a third person to confirm a play result of the dart game or a play process of the dart game, or a method, by which a dart game apparatus itself compels the participant of the dart game to inevitably play the dart game by a just method, is required in order to authenticate whether a counterpart player plays the dart game by a just method.

DISCLOSURE

Technical Problem

The present invention is conceived in consideration of the aforementioned matters, and is to authenticate whether a counterpart player plays a dart game in a just manner in a remote multi-mode.

Technical Solution

An exemplary embodiment of the present invention provides a dart game apparatus, including: a throw line configured to indicate a position, at which a dart is thrown; and a touch unit extended from the throw line in an opposite direction of a dart target, in which only when a dart game player throws the dart in a state of touching the touch unit, it is authenticated that a dart game is justly performed.

Only when the dart game player throws the dart in a state of touching the touch unit, a dart score may be admitted.

The dart game apparatus may further include a first camera configured to photograph at least a part of the dart game player, in which when the dart game player touches the touch unit, the first camera may start photographing.

The dart game apparatus may further include a second camera configured to photograph at least a part of the dart target, in which when the dart game player touches the touch unit, the second camera may start photographing.

The dart game apparatus may further include: a memory configured to store at least a part of moving images photographed by the first and second cameras; a network connection unit configured to transmit the moving image stored in the memory through a network; and a controller configured to control operations of the first and second cameras, and transmission of the moving image.

Another exemplary embodiment of the present invention provides a dart game apparatus, including: a dart target having a plurality of score areas; a sensing unit configured to sense a hit of a dart; and a bottom part including lighting units, in which some of the lighting units indicate a throw line, and the throw line is indicated when the lighting unit indicating the throw line is turned on in the bottom part, and the throw line is not indicated when the lighting unit indicating the throw line is not turned on in the bottom part.

The bottom part may further include a touch unit extended from the throw line in an opposite direction of the dart target, and only when a dart game player throws the dart in a state of touching the touch unit, it may be authenticated that a dart game is justly performed.

Only when the dart game player throws the dart in a state of touching the touch unit, a dart score may be admitted.

The dart game apparatus may further include a first camera configured to photograph at least a part of the dart game player, in which when the dart game player touches the touch unit, the first camera may start photographing.

The dart game apparatus may further include a second camera configured to photograph at least a part of the dart target, in which when the dart game player touches the touch unit, the second camera may start photographing.

The lighting unit indicating the throw line may be turned on when a dart game starts in the dart game apparatus.

The dart game apparatus may further include: a memory configured to store at least a part of moving images photographed by the first and second cameras; a network connection unit configured to transmit the moving image stored in the memory through a network; and a controller configured to control operations of the first and second cameras, and transmission of the moving image.

Still another exemplary embodiment of the present invention provides a method of authenticating whether a dart game player justly participates in a dart game by a dart game apparatus, in which a remote multi-mode is available, the method including: confirming whether a touch unit is touched by the dart game player; and authenticating that the dart game is justly played when the touch unit is touched.

The method may further include: when the touch unit is touched, photographing, by at least some of a plurality of cameras, at least a part of the dart game player or at least a part of the dart target; and authenticating that the dart game is justly played based on the photographed image.

Yet another exemplary embodiment of the present invention provides a method of authenticating whether a dart game player justly participates in a dart game by a dart game apparatus, in which a remote multi-mode is available, the method including: indicating a throw line or a touch unit when the dart game apparatus starts; recognizing, by the dart game player, the touch unit from the indicated throw line or the indicated touch unit; confirming whether a touch unit is touched by the dart game player; and authenticating that the dart game is justly played when the touch unit is touched.

The method may further include: when the touch unit is touched, photographing, by at least some of a plurality of cameras, at least a part of the dart game player or at least a part of the dart target; and authenticating that the dart game is justly played based on the photographed image.

Still yet another exemplary embodiment of the present invention provides a computer readable recording medium for authenticating, by one or more computer, whether a dart game player justly participates in a dart game in a dart game apparatus, in which a remote multi-mode is available, the computer readable recording medium including: a computer program code configured to cause at least one computer to confirm whether a touch unit is touched by the dart game player; and a computer program code configured to cause at least one computer to authenticate that the dart game is justly played when the touch unit is touched.

The computer readable recording medium may further include: a program code configured to cause at least one computer to photograph at least a part of the dart game player or at least a part of the dart target through at least some of a plurality of cameras when the touch unit is touched; and a program code configured to cause at least one computer to authenticate that the dart game is justly played based on the photographed image.

Advantageous Effects

According to the configuration of the present invention, only when a dart game player touches the touch unit even in a remote multi-mode, the dart game player may be admitted to justly play a dart game, so that it is possible to improve reliability of the remote multi-mode game, and thus increase the number of dart game players participating in the remote multi-mode game. Accordingly, the present invention may considerably influence propagation of a dart game.

DESCRIPTION OF DRAWINGS

FIG. 1 is a block diagram of a dart game apparatus related to an exemplary embodiment of the present invention.

FIG. 2 is a conceptual diagram of a game network including the dart game apparatus related to the exemplary embodiment of the present invention.

FIG. 3 is a diagram illustrating photographing regions of first and second cameras.

FIG. 4 is a diagram illustrating a case where a moving image for a predetermined time section including a moment, at which a dart game motion is detected, is stored in a memory.

FIG. 5 is a diagram illustrating a moving image stored with a point of a dart game motion.

FIG. 6 is a diagram illustrating a moving image of a dart game of which first authentication is completed.

FIG. 7 is a diagram illustrating a web page displaying a result of the dart game, of which the first authentication is completed.

FIG. 8 is a signal flowchart illustrating a method of authenticating dart game data of the dart game apparatus related to the exemplary embodiment of the present invention.

FIG. 9 illustrates the dart game apparatus including a touch unit according to the exemplary embodiment of the present invention.

FIG. 10 illustrates a dart game apparatus including a touch unit according to another exemplary embodiment of the present invention.

FIG. 11 illustrates a throw line and a touch unit according to an exemplary embodiment of the present invention.

FIG. 12 illustrates a dart game apparatus including a touch unit according to still another exemplary embodiment of the present invention.

FIG. 13 illustrates a dart game apparatus including a touch unit according to yet another exemplary embodiment of the present invention.

FIG. 14 illustrates a throw line and a touch unit according to another exemplary embodiment of the present invention.

FIG. 15 is a flowchart of a method of authenticating whether a dart game player justly participates in a dart game according to an exemplary embodiment of the present invention.

FIG. 16 is a flowchart of a method of authenticating whether a dart game player justly participates in a dart game according to another exemplary embodiment of the present invention.

BEST MODE

Various exemplary embodiments will be described with reference to the accompanying drawings. In the description below, various descriptions are present through the exemplary embodiments for illustration. However, it is apparent that the exemplary embodiments may be executed without a specific description. In other examples, publicly-known structures and devices are present in a form of a block diagram in order to easily describe the exemplary embodiments.

Terms "component", "module", "system", and the like used in the present specification refer to a computer-related entity, hardware, firmware, software, a combination of software and hardware, or execution of software. For example, the component may be a processing process, a processor, an object, an execution thread, a program, and/or a computer executed in a processor, but is not limited thereto. For example, all of an application executed in a computing device and the computing device may be components. One or more components may reside within a processor and/or an execution thread, and one component may be localized within one computer, or distributed between two or more computers. Further, the components may be executed by various computer readable media having various data structures stored in the media. The components may be communicated through local and/or remote processing according to, for example, a signal (for example, data through a network, such as another system and the Internet, through data and/or a signal from one component inter-working with another component in a local system and a distribution system) including one or more data packets.

Further, various aspects or characteristics present herein may be implemented with a manufactured article using a method, an apparatus, or a standard programming, and/or engineering technology. A term "manufactured article" includes a computer program, a carrier, or a medium accessible by a predetermined computer readable device. For example, the computer readable medium includes a magnetic storage device (for example, a hard disc, a floppy disc, and a magnetic strip), an optical disc (for example, a CD and a DVD), a smart card, and a flash memory device (for example, an EEPROM, a card, stick, and a key drive), but is not limited thereto. Further, various storage media present herein includes one or more devices and/or another machine-readable medium for storing information. A term "machine-readable medium" includes a wireless channel and other various media capable of storing, possessing, and/or transferring a command(s) and/or data, but is not limited thereto.

FIG. 1 is a block diagram of a dart game apparatus related to an exemplary embodiment of the present invention.

The dart game apparatus 100 may include a dart target 110, a sensing unit 120, a user input unit 130, an output unit 140, a camera unit 150, a network connection unit 160, a user authenticating unit 170, a memory 180, and a controller 190. Since the constituent elements illustrated in FIG. 1 are not essential, a mobile terminal may be implemented to have more constituent elements or less constituent elements.

Hereinafter, the constituent elements will be described in sequence.

The dart target 110 may mean a score board, in which a bull's-eye is positioned at a center thereof, and which includes areas, which are divided by concentric circles having the bull's-eye as a center and straight lines radially extended from the bull's-eye and have assigned scores, respectively. A plurality of holes, into which a tip of a dart may be fitted, may be disposed on the score board.

The dart target 110 includes a display 142, which will be described below, to variably change a point disposition and a shape of the areas, to which the scores are assigned, of the dart target 110. In this case, the dart target 110 may include a light transmissive touch pad, so that the light transmissive touch pad is stacked on the display 142, to have a form of a touch screen.

The sensing unit 120 senses a play of a dart game player performed with respect to the dart target 110 to evaluate the actual play of the game player. For the game, in which the game player throws a dart, the sensing unit 120 may sense an area of the dart target 110, into which the thrown dart is put. The sensing unit 120 may electrically convert a score corresponding to the area, into which the dart is put, and transmit the converted point to the controller 190.

The user input unit 130 receives a user input for controlling the dart game apparatus 100. The user input unit 130 may include a key pad, a dome switch, a touch pad (capacitive/resistive), a jog wheel, a jog switch, and the like. The user input 130 may also include cameras 151, . . . , and 153, a microphone, and the like.

A user may select a dart game mode, the number of dart game players, a dart game play scheme, and the like through the user input unit 130. For example, the user may select the number of dart game players, a dart game play scheme (a zero-one game, a cricket game, and the like), and a dart game mode (one-person play, a network play, and the like).

The user input unit 130 may detect a key operation or a touch input of the user to receive a signal, or receive a voice or an operation through the cameras 151, . . . , and 153 or the microphone of the user and convert the received voice or operation into an input signal. To this end, publicly-known speech recognition technology or motion recognition technology may be used.

The output unit 140 generates an output related to a visual sense, an auditory sense, a tactile sensor, or the like, and may include a sound output module 141, the display unit 142, a notification unit 143, and the like.

The sound output module 141 may output audio data received from the network connection unit 160 or stored in the memory 180 among sound effects of a game, a game operation guide, a game method explanation, and the like. The sound output module 141 may also output a sound signal related to a function (for example, a game sound effect) performed by the dart game apparatus 100. The sound output module 141 may output a sound from a game player using another dart game apparatus 200 (see FIG. 2) received through the network connection unit 160 or a third person. The sound output module 141 may include a receiver, a speaker, a buzzer, and the like.

The display 142 displays (outputs) information processed by the dart game apparatus 100. For example, when the dart game apparatus 100 is in a game play scheme guide mode, the display 142 may output a selectable game play scheme. When the dart game apparatus 100 is being operated, the display 142 may display a score sensed through the sensing unit 120, or output an image obtained by photographing the game player using another dart game apparatus 200 (see FIG. 2) received through the network connection unit 160 or a third person.

The display 142 may include at least one of a liquid crystal display (LCD), a thin film transistor-liquid crystal display (TFT LCD), an organic light-emitting diode (OLED) display, a flexible display, and a 3D display.

Among them, some of the displays may be implemented in a transparent type or a light transmission type so that the outside can be seen therethrough. These types of displays may be called transparent displays, and a representative example of the transparent display includes a transparent OLED (TOLED).

The dart game apparatus 100 may include two or more displays 142 according to an implementation form thereof. For example, multiple displays may be disposed to be spaced apart from each other or to be integrated with each other on one surface of the dart game apparatus 100, or may be disposed on different surfaces of the dart game apparatus 100, respectively.

The touch sensor may be configured to convert a pressure applied to a particular portion of the display 142 or a change in capacitance and the like generated at a particular portion thereof, into an electrical input signal. The touch sensor may be configured to detect even a pressure of a touch, as well as a position and an area of the touch.

When the touch sensor 137 senses a touch input, a signal(s) corresponding to the touch input is transmitted to a touch controller. The touch controller processes the signal(s), and then transmits data corresponding to the processed signal(s) to the controller 190. Accordingly, the controller 190 may determine which area of the display 142 has been touched, and the like.

The notification unit 143 outputs a signal for notifying the user that an event of the dart game apparatus 100 has occurred. An example of the event generated in the dart game apparatus 100 includes identification of a dart game player, hit of the bull's-eye of the dart, a change of a dart game player, an end of a game, and the like. The notification unit 143 may also output other types of signals, for example, a signal for notifying the occurrence of an event through vibration, as well as a video signal or an audio signal. The notification unit 143 may include a light emission diode (LED), so that the notification unit 143 may notify the user of the occurrence of an event through flickering of the LED.

The camera unit 150 may include the plurality of cameras 151, . . . , and 153, so that image frames processed by the cameras 151, . . . , and 153 may be stored in the memory 180 or transmitted to the outside through the network connection unit 160. Two or more cameras 150 may be included according to a use environment.

At least some cameras of the camera unit 150 may be disposed so as to photograph an image frame including the dart target 110, and some other cameras may be disposed so as to photograph an image frame directly related to a game rule in the dart game play. For example, the cameras may be disposed so as to photograph a throw line, on which the player throws the dart, in order to photograph an image frame directly related to the rule of the dart game. The plurality of cameras 151, . . . , and 153 included in the camera unit 150 may be disposed so that at least some image frames are photographed while overlapping.

When one camera is included in the camera unit 150, the camera may be a panoramic camera disposed so as to photograph all of at least a part of the dart target 110 and an image frame (for example, the throw line in the dart game) directly related to the game rule.

The network connection unit 160 may include one or more modules, which enables the dart game apparatus 100 and a wired/wireless communication system or the dart game apparatus 100 and a network, in which the dart game apparatus 100 is located, to wirelessly communicate with each other.

The network connection unit 160 may include a wired/wireless Internet module for a network connection. Wireless local area network (WLAN) (for example, Wi-Fi), wireless broadband (Wibro), world interoperability for microwave access (Wimax), high speed downlink packet access (HSDPA), and the like may be used as wireless Internet technology. A digital subscriber line (XDSL), fibers to the home (FTTH), power line communication (PLC), and the like may be used as wired Internet technology.

Further, the network connection unit 160 may include a short range communication module, and transceive data with an electronic device, which is positioned at a comparatively short distance from the dart game apparatus 100 and includes a short range communication module. As the short range communication technology, a Bluetooth, a radio frequency identification (RFID), an infrared data association (IrDA), an ultra wideband (UWB), a ZigBee, and the like may be used.

The network connection unit 160 may detect a connection state of a network and a transception speed of the network.

Data received through the network connection unit 160 may be output through the output unit 140, stored through the memory 180, or transmitted to other electronic devices, which are located within a short distance, through the short range communication module.

The user authenticating unit 170 may recognize unique information about a remote user by using radio waves by using RFID technology that is a kind of short range communication technology. For example, the user may possess a card, a mobile terminal, or unique dart game equipment, for example, personal dart equipment possessed by the user, including an RFID module. Information (for example, a personal ID and an identification code registered in a database server DB (see FIG. 2)) for identifying the user may be recorded in the RFID module possessed by the user. The dart game apparatus 100 may identify the RFID module possessed by the user, so that the dart game apparatus 100 may identify a dart game player playing a dart game by using the dart game apparatus 100, and update a database for the identified dart game player or accumulate new data.

The user authenticating unit 170 may include various technologies (for example, a short range communication technology, such as Bluetooth) capable of transceiving unique information about a user by a contact/non-contact manner, in addition to the RFID technology. Further, the user authenticating unit 170 may include a biometric data identification module for identifying biometric data (a voice, a fingerprint, and a face) of the user in linkage with the microphone, the touch pad, the camera unit 150, and the like of the user input unit 130.

The memory 180 may store a program for an operation of the controller 190, and also temporally store input/output data (for example, a phone book, a message, a still image, and a moving image). The memory 180 may store data associated with vibrations and sounds of various patterns output when a touch is input to the touch screen.

The memory 180 may include at least one type of storage medium among a flash memory type, a hard disk type, a multimedia card micro type, a card type memory (for example, an SD memory, an XD memory or the like), a random access memory (RAM), a static RAM (SRAM), a read-only memory (ROM), an electrically erasable programmable ROM (EEPROM), a programmable read-only memory (PROM), a magnetic memory, a magnetic disk, and an optical disk. The dart game apparatus 100 may be operated in association with a web storage that executes a storage function of the memory 180 on the Internet.

The controller 190 generally controls the general operation of the dart game apparatus 100. For example, for the dart game, the controller 190 collects a point sensed by the sensing unit 120 for each game participant, transceives the collected scores with another dart game apparatus 200 connected through the network, and records a game win/lose record, scores, and the like according to a result of the collection.

The controller may perform pattern recognition processing, through which an operation input, a writing input, and the like performed through the touch screen or the camera may be recognized as a character or an image. Further, the controller may perform speech recognition by using a speech-to-text (STT) function, which may recognize a voice input through the microphone as a text.

The various exemplary embodiments described herein may be implemented in, for example, a recording medium readable by a computer or an apparatus similar to the computer by using software, hardware, or a combination thereof.

For hardware implementation, the exemplary embodiments described herein may be implemented by using at least one of application specific integrated circuits (ASICs), digital signal processors (DSPs), digital signal processing devices (DSPDs), programmable logic devices (PLDs), field programmable gate arrays (FPGAs), processors, controllers, microcontrollers, microprocessors, and other electrical units for executing functions. In some cases, the exemplary embodiments described in the present specification may be implemented by the controller 190 itself.

For software implementation, the exemplary embodiments, such as procedures and functions described in the present specification may be implemented by separate software modules. Each of the software modules may perform one or more functions and operations described in the present specification. A software code may be implemented by a software application written in an appropriate programming language. The software code may be stored in the memory 180, and may be executed by the controller 190.

The dart game apparatus 100 may include a touch unit 195, which is positioned in a predetermined area adjacent to the throw line indicating a position for throwing a dart by a dart game player, and authenticates whether the dart game player justly plays the dart game.

The touch unit 195 may be extended from the throw line in a direction of being distant from the dart target 110, and may authenticate that the dart game is justly performed only when the dart game player throws a dart in a state of touching the touch unit 195.

FIG. 9 illustrates the dart game apparatus including the touch unit according to the exemplary embodiment of the present invention.

Referring to FIG. 9, the dart game apparatus 100 may include a bottom part 901. In the present exemplary embodiment, the bottom part 901 has a form protruding from a ground surface by a predetermined height, and may include a throw line 902 and a touch unit 903.

The touch unit 903 occupies a predetermined area of the bottom part 901 from the throw line 902 in a direction of being distant from the dart target. Only when a dart game player 904 throws a dart in a state of touching the touch unit 903, for example, when the dart game player 904 throws the dart in a state of stepping on the touch unit 903, a score of the dart game player 904 may be admitted. Through the aforementioned configuration, even though remote dart game players do not check other players each other with the eyes in the remote multi-game mode, it may be authenticated that the dart game player throws the dart at a just position, so that the game is justly performed.

FIG. 10 illustrates a dart game apparatus including a touch unit according to another exemplary embodiment of the present invention.

Referring to FIG. 10, in contrast to FIG. 9, the bottom part does not protrude from the ground surface by a predetermined height, but is buried in the ground surface. Otherwise, in the present exemplary embodiment, the bottom part is not separately provided, but may mean an area including a throw line 1001 and a touch unit.

In FIG. 10, only the throw line 1001 is recognized by a dart game player 1002, and only when the dart game player touches, for example, steps on, a predetermined area from the throw line 1001 in a direction of being distant from a dart target, and plays the dart game, it may be authenticated that the dart game player justly performs the dart game.

FIG. 11 illustrates a throw line 210 and a touch unit 220 according to an exemplary embodiment of the present invention.

Referring to FIG. 11, the touch unit 220 is provided in a form of a predetermined quadrangular area adjacent to the throw line 210, so that only when a dart game player touches, for example, steps on, the touch unit 220 and plays a dart game, it may be authenticated that the dart game player justly performs the dart game.

FIG. 12 illustrates a dart game apparatus including a bottom unit according to still another exemplary embodiment of the present invention.

The sound output module 141, the display 142, or the notification unit 143 described in relation to FIG. 1 may also be included in a plurality of structures, which may be included in the dart game apparatus 100. The plurality of structures may include at least one of a dart game apparatus, a throw line, a path, a pillar, a wall, a table, and a chair. In the sound output module 141, the display 142, or the notification unit 143 included in the plurality of structures, a flickering manner and a pattern of a color change of the notification unit 143 or the display 142, and a pattern of a sound effect of the sound output module 141 may be changed according to the generation of events generated in the dart game, and the change of the pattern may be controlled by the controller 190. The notification unit 143 may be, for example, an LED lighting unit as described above.

The memory 180 may store the patterns of the sound output module 141, the display 142, or the notification unit 143 included in the plurality of structures.

Referring to FIG. 12, the dart game apparatus 100 may include a bottom part 1201. In the exemplary embodiment, the bottom part 1201 has a form protruding from a ground surface by a predetermined height, and may include a throw line 1202 and a touch unit 1203.

The touch unit 1203 occupies a predetermined area of the bottom part 1201 from the throw line 1202 in a direction of being distant from a dart target. Only when a dart game player 1204 throws a dart in a state of touching the touch unit 1203, for example, when the dart game player 1203 throws the dart in a state of stepping on the touch unit 903, a score of the dart game player 1204 may be admitted.

Only when events generated in a dart game are generated, the notification unit 143, which has, for example, a form including an LED lighting, executes a predetermined lighting pattern, so that the throw line 1202 may be recognized to a dart game player.

In the present exemplary embodiment, the bottom part 1201 is formed of a semi-transmissive material, and is transparent so that a dart game player can recognize the bottom part 1201 only when the notification unit 143 of the throw line 1202 is turned on, but when the notification unit 143 is turned off, the bottom part 1201 is opaque so that a dart game player cannot recognize a position, at which a lighting unit is buried. Since the notification unit of the throw line is not turned on when an event of the dart game is not generated, for example, the dart game apparatus does not start, the dart game player cannot recognize the throw line. However, when the dart game player starts the dart game apparatus, the notification unit is turned on when the game initially starts, so that the throw line 1202 may be displayed. For example, the dart game apparatus may have a form starting when a dart game player inserts a coin, and in this case, the lighting unit of the throw line is turned on only when the dart game player inserts a coin and starts a game, so that the throw line may be displayed.

The reason why the semi-transparent member is installed, the notification unit capable of indicating at least the throw line is buried under the semi-transparent member, and the lighting unit of the throw line is turned on only when a user starts the dart game apparatus is to prevent a user from performing a dart game practice at the throw line without inserting a coin without starting the dart game apparatus, particularly, when the dart game apparatus has the form starting only when the user inserts the coin. When the user does not start the dart game apparatus, the user cannot accurately recognize a distance of the throw line, so that it is possible to prevent the user from occupying the dart game apparatus in order to perform a dart game practice. Particularly, when the dart game apparatus has the form starting when a user inserts a coin, it is possible to prevent a user from performing a dart game practice without cost burdens.

According to the present exemplary embodiment, when an event generable in the dart game is generated, for example, when a dart game player justly pays costs and starts the dart game apparatus, the throw line 1202 including the notification unit 142 buried in the bottom part 1201, which is the opaque member, may be recognized by the dart game player through the activation of the notification unit 143, and only when the dart game player touches, for example, steps on, the touch unit 1203 positioned from the throw line 1202 in the direction of being distant from the dart target and throws a dart, it may be admitted that the dart game is justly played in the remote multi-mode game.

FIG. 13 illustrates a dart game apparatus including a touch unit according to yet another exemplary embodiment of the present invention.

Referring to FIG. 13, a bottom part may be formed of a semi-transmissive material and have a form buried in a ground surface. The bottom part may include a throw line 1301, and include a touch unit extended from the throw line 1301 in a direction of being distant from a dart target.

The throw line 1301 may have a form including the notification unit 143, and as described with reference to FIG. 12, when an event generable in the dart game is generated, for example, a dart game player 1302 justly pays costs and starts the dart game apparatus, the throw line 1301 including the notification unit 143 buried in the bottom part, which is the opaque member, may be recognized by the dart game player through activation of the notification unit 143, and only when the dart game player touches, for example, steps on, the touch unit positioned from the throw line 1301 in a direction of being distant from a dart target and throws a dart, it may be admitted that the dart game is justly played in the remote multi-mode game.

FIG. 14 illustrates a throw line and a touch unit according to another exemplary embodiment of the present invention.

Referring to FIG. 14, a touch unit 320 may include the notification unit 143, when an event generable in the dart game is generated, for example, a dart game player justly pays costs and starts the dart game apparatus, the touch unit 320 including the notification unit 143 buried in the bottom part, which is the opaque member, may be recognized by the dart game player through activation of the notification unit 143, and only when the dart game player touches, for example, steps on, the touch unit 320 and throws a dart, it may be admitted that the dart game is justly played in the remote multi-mode game.

As is apparently recognized by those skilled in the art, the exemplary embodiment described with reference to FIGS. 9 to 14 is illustrative, and the sound output module 141, the display 142, and the notification unit 143 may be installed in at least one of the bottom part, the throw line, and the touch unit, and one or more of the sound output module 141, the display 142, and the notification unit 143 may be appropriately displayed.

Some of the cameras of the camera unit 150 photograph at least a part of the dart target, and when the dart game player touches the touch unit, some of the cameras of the camera unit 150 may start photographing. Further, some of the cameras of the camera unit 150 photograph at least a part of the dart game player, and when the dart game player touches the touch unit, some of the cameras of the camera unit 150 may start photographing.

The camera unit 150 will be described in more detail below.

Hereinafter, a situation where the dart game apparatus according to the exemplary embodiment of the present invention is connected with a network will be described in more detail with reference to the drawings.

FIG. 2 is a conceptual diagram of a game network including the dart game apparatus related to the exemplary embodiment of the present invention.

As illustrated in FIG. 2, the dart game apparatus 100 used by a first game player P1 may be connected to one or more servers (a media server MS, a relay server RS, and a dart game server GS) through a network.

The plurality of dart game players may enjoy the dart game at the same time and the same space by using the same first dart game apparatus 100. However, when a second dart game player P2 located at a remote location from the first dart game player P1 desires to participate in the dart game, the second dart game player P2 may perform the dart game by connecting to one or more servers (the media server MS, the relay server RS, and the dart game server GS) through the network, and transceiving information with the first dart game apparatus 100 by using a second dart game apparatus 100. The first dart game apparatus 100 and the second dart game apparatus may transceive information through one or more servers (the media server MS, the relay server RS, and the dart game server GS), or directly transceive information with each other.

The dart game may be performed in a manner in which two dart game players P1 and P2 play the dart game at different places at the same time, or a manner in which two dart game players P1 and P2 play the dart game at different places at different times, play contents are stored in a DB server DB, and a win/lose or a ranking is determined The media server MS may store dart game play moving images of the dart game players P1 and P2 stored in the dart game apparatuses 100 and 200 by using the camera or the microphone. The media server MS may be included in the DB server DB.

The relay server RS may connect communication between the plurality of dart game apparatuses 100 and 200. The relay server RS may establish a communication network between the plurality of dart game apparatuses 100 and 200 located at a remote location, and establish a peer-to-peer (P2P) network.

The game server GS may exchange information (a score obtained by each game player, and information for mutual communication between the game players) or transmit an advantage or a warning under the game rule through each of the dart game apparatuses 100 and 200, or, in addition, transceive information necessary for performing the dart game and control the dart game apparatuses 100 and 200. The dart game server GS may collect a win/lose of the dart game, a score of each of the dart game apparatuses 100 and 200, and the like, and transmit the collected win/lose, point, and the like to the DB server.

The DB server may store personal information of each of the dart game players P1 and P2, information on win/lose and ranking of the game, score information for each game, a replay moving image for each game, or the like. The DB server may divide and store the information based on each user. The DB server may assign a unique code to each user, and manage information about each user by using the unique code. The unique code may be stored in the RFID module (an RFID card, an RFID module stored in a mobile terminal, or the like) possessed by each user. Accordingly, the dart game apparatuses 100 and 200 may identify each game player through the user authenticating units 170 included therein. The DB server may also assign a unique code to each of the dart game apparatuses 100 and 200 for identification, and manage the dart game data based on an identification code assigned to each of the dart game apparatuses 100 and 200.

A game player may be connected to a web server WS by using a mobile device (an electronic device 300, such as a mobile terminal, a cellular phone, a PDA, and a PDP, having an embedded mobile communication function) or a PC 400. The web server WS may be connected to the mobile device 300 and the PC 400 by using the Internet or the Intranet. Further, the web server WS may be connected with the dart game apparatuses 100 and 200. The web server WS may be connected with the DB server DB to provide a dart game player with dart game data stored in the DB server.

As illustrated in FIG. 1, the dart target 110 may include a plurality of predetermined divided areas. For example, the bull's-eye may be disposed at the center of the dart target 110, and the plurality of areas may be divided based on the plurality of concentric circles based on the bull's-eye and the radially extended straight lines, and a score may be assigned to every area.

In the exemplary embodiment of the present invention, the camera unit 150 may include the plurality of cameras 151, 152, . . . , and 153.

A first camera 151 included in the camera unit 150 may be disposed so as to photograph at least a part of a dart game player. For example, the first camera 151 may photograph at least a part of a dart game player including the throw line. There are many cases where whether the game rule is violated in the dart game is dependent on whether a dart game player violably crosses the throw line. Accordingly, when the first camera 151 photographs an image frame including the throw line, the first camera 151 may photograph a moving image including an image frame, which is essential to determine a false play of the dart game player.

A second camera 152 included in the camera unit 150 may be disposed so as to photograph at least a part of the dart target.

FIG. 3 is a diagram illustrating photographing areas of first and second cameras.

As indicated by a dashed-line of FIG. 3, the first camera 151 may photograph a region R1 including at least a part of a game player. As indicated by a solid line, the second camera 152 may photograph a region R2 including at least a part of the dart target.

As illustrated in FIG. 3, the first camera 151 and the second camera 152 may include a common photographing region R3.

The controller 190 may generate a panorama image, in which the images photographed by the first camera 151 and the second camera 152 are connected, by using the common photographing region R3.

The memory 180 may store at least a part of the moving images photographed by the first and second cameras. The moving image stored in the memory 180 may be transmitted to the outside by the network connection unit 160, and then deleted.

The network connection unit 160 may transmit the moving image stored in the memory 180 through the network. The moving image may be transmitted to the media server MS, or transmitted to the database server DB through the game server GS.

In another exemplary embodiment of the present invention, the sensing unit 120 may sense a game motion for the dart target 110. For example, the sensing unit 120 may sense a position of the dart target, into which the dart is put, convert the sensed position into a score corresponding to the position, into which the dart is put, and transmit the point to the controller 190.

The controller 190 may store a moving image for a predetermined time section including a time point, at which the game motion (for example, a motion that the dart is put into the dart target 110 in the dart game) is sensed by the sensor, in the memory.

In yet another exemplary embodiment of the present invention, the controller 190 may detect a time point, at which a game motion is generated, by using the moving image stored in the memory, and store a moving image for a predetermined time section including a time point, at which the game motion is sensed, in the memory.

The controller 190 may analyze a moving image (for example, when a rapidly moving dart is detected in the moving image, it is determined that the game motion is sensed) by using publicly known image processing technology.

FIG. 4 is a diagram illustrating a case where a moving image for a predetermined time section including a moment, at which a dart game motion is detected, is stored in the memory.

As illustrated in FIG. 4, the dart game apparatus 100 may detect time points, (for example, times points E1, E2, and E3, at which the dart is put into the dart target), at which dart game motions are generated, by using the image processing technology of the sensing unit 120 or the controller 190.

The dart game apparatus 100 may store all of the moving images photographed by the first and second cameras 151 and 152 by using a buffer formed by a predetermined area of the memory 180 or a separate memory.

The controller 190 may selectively extract moving images corresponding to time sections T1, T2, and T3 including the time points E1, E2, and E3, at which the dart game motions are generated, from the buffer, and store the extracted moving images in the memory 180. The time sections T1, T2, and T3 may be identically set or differently set with respect to the moving images photographed by the first camera and the second camera 151 and 152.

For example, the controller 190 may store moving images photographed for one second before the generation of all of the game motions and moving images photographed for three seconds after the generation of all of the game motions with respect to the moving images photographed by the first camera and the second camera 151 and 152. By contrast, the controller 190 may store a moving image for one second before the generation of the game motion and a moving image photographed for three seconds after the generation of the game motion with respect to the moving image photographed by the first camera 151, and store a moving image for three seconds before the generation of the game motion and a moving image for one second after the generation of the game motion with respect to the moving image photographed by the second camera 152.

The controller 190 may store a moving image photographed for a time section, in which the game motion generation points E1, E2, and E3 are not included, in the memory 180 for the moving image photographed by any one camera among the first and second cameras 151 and 152.

For example, for the moving image photographed by the second camera 152, the controller 190 may store a moving image photographed for a time section from three seconds after the generation of the game motion to six seconds after the generation of the game motion in the memory 180.

Hereinafter, an exemplary embodiment, in which a moving image including a score of a game motion is generated and stored, will be described in detail with reference to the drawings.

FIG. 5 is a diagram illustrating a moving image stored with a score of a game motion.

In yet another exemplary embodiment, the controller 190 may evaluate a game motion for the dart target 110 and calculates a score, generate a moving image, in which the calculated score is displayed in at least a part of the moving image, and store the generated moving image in the memory 180.

As illustrated in FIG. 5, for example, in a dart game, the controller 190 may evaluate a score for a game motion. For example, when a dart is put into a region of the dart target 110 corresponding to 19 points, the game motion may be evaluated as 19 points.

The controller 190 may generate a moving image, in which the evaluated score S displayed in a predetermined region of the image, by using the moving image stored in the memory 180. The score S may be disposed at an edge portion of the image, or displayed in a semi-transparent form so that the score S is not displayed while overlapping a main scene of the game motion.

Hereinafter, an exemplary embodiment, in which a game motion is first authenticated through the user authenticating unit, will be described in detail with reference to the drawings.

FIG. 6 is a diagram illustrating a moving image of a game of which first authentication is completed.

FIG. 7 is a diagram illustrating a web page displaying a result of the game, of which the first authentication is completed.

According to yet another exemplary embodiment of the present invention, after a game motion is generated, unique information about another game player, which does not perform a game motion, may be received by the user authentication unit 170. In this case, the controller 190 processes that a moving image including the game motion is first authenticated.

When a third person located at the same plate with a game player checks a play of the game player and evaluates the play of the game player as a just play, the third person may input his/her unique information through the user authentication unit 170. In this case, the controller 180 may determine game data as game data having relatively high reliability, and determine that the game data is first authenticated.

When the controller 180 generates a moving image for authenticating the game play, the controller 180 may display the first authenticated moving image while discriminating the first authenticated moving image from other images.

As illustrated in FIG. 6, the controller 190 may generate a moving image indicating that the moving image is first authenticated for the first authenticated moving image and store the generated moving image in the memory 180.

The servers GS, DS, RS, and MS may manage the first authenticated game data while discriminating the first authenticated game data from other game data.

As illustrated in FIG. 7, a dart game player may read his/her game data or game data of other game players through the web server WS. The dart game player may read a game moving image of another game player through the web server WS, and authenticate whether game data of another game player is generated by a false play.

The web server WS may admit the game data (data authenticated by the predetermined number or more of people, data authenticated by users (for example, referees) having an authorization assigned by the server) satisfying a predetermined reference as authenticated official game data. The web server WS may separately manage the official game data.

When a user selects an icon I1, the web server WS may provide a web page indicating all of the rankings and game data including previously authenticated game data and non-authenticated game data.

When the user selects an icon I2, the web server WS may provide a web page indicating a ranking and game data considering only previously authenticated game data.

The web server WS may provide a web page including an icon I3 indicating the first authenticated game data.

In yet another exemplary embodiment of the present invention, the controller 190 may schedule a transmission time of the moving image according to a state of a network connected with the dart game apparatus 100. The network connection unit 160 may transmit the moving image stored in the memory 180 according to scheduling. In this case, the controller 190 may schedule a transmission time of the moving image considering at least one of the amount of traffic of the network, whether a connection to the network is available, and a connection available time.

Hereinafter, a method of authenticating game data of the game apparatus related to the exemplary embodiment of the present invention will be described in detail with reference to the drawing.

FIG. 8 is a signal flowchart illustrating a method of authenticating dart game data of the dart game apparatus related to the exemplary embodiment of the present invention.

The dart game apparatus 100 photographs at least a part of a game player and at least a part of the dart target (S110). The dart game apparatus 100 stores at least a part of a photographed moving image (S120). The camera may be disposed so as to photograph the throw line in the dart game, or the plurality of cameras may be disposed so as to have common photographed regions.

In storing at least a part of the photographed moving image, the dart game apparatus 100 may temporally store all of the photographed moving images in the buffer (S121). The dart game apparatus 100 may selectively store moving images photographed for a time section including a time point, at which a dart game motion is generated, among the moving images temporally stored in the buffer, in the memory (122).

The dart game apparatus 100 may calculate a score by evaluating the game motion of the game player (S123), and the dart game apparatus 100 may generate a moving image, in which the evaluated point is displayed in at least a part of the image (S124).

When unique information about a third person is received through the user authentication unit 170 after the dart game motion related to the generation of the moving image is performed, the dart game apparatus 100 may process that the moving image corresponding to the dart game motion is first authenticated.

The first authentication process may be repeatedly performed for every game motion, or first authentication process may be performed one in a lump for one game after one game is terminated.

When unique information about a third person is not received through the user authenticating unit 170, the dart game apparatus 100 proceeds to a next operation S140 without performing the first authentication process.

The dart game apparatus 100 may schedule a transmission time of the moving image (S140), and transmit the moving image to the server through the network according to a result of the scheduling.

FIG. 15 is a flowchart of a method of authenticating whether a dart game player justly participates in a dart game according to the exemplary embodiment of the present invention.

First, whether the touch unit is touched by a dart game player may be confirmed (1501). For example, whether the dart game player throws a dart in a state of stepping on the touch unit may be confirmed. Next, when the touch unit is touched, whether the dart game is justly played may be authenticated (1502). For example, it is authenticated that the dart game is justly played, and a score of the dart game player may be transmitted to a counterpart player through the network. Next, when the touch unit is touched, at least some of the plurality of cameras may photograph at least a part of the dart game player or at least a part of the dart target (1503). Next, it may be authenticated that the dart game is justly played based on the photographed image (1504). The photographed image may be transmitted to a counterpart player, a third person, or a referee through the network connection unit, and second authentication may be performed based on the photographed image.

FIG. 16 is a flowchart of a method of authenticating whether a dart game player justly participates in a dart game according to another exemplary embodiment of the present invention.

First, when the dart game apparatus starts, the throw line or the touch unit may be displayed (1601). For example, only when the dart game player inserts a coin into the dart game apparatus and justly starts the dart game apparatus, the throw line or the touch unit may be displayed, for example, in a form, in which a lighting is turned on, in the bottom part formed of a semi-transmissive member. Next, the touch unit may be recognized from the throw line, or the displayed touch unit may be recognized by the dart game player (1602). For example, when the throw line is displayed, a predetermined area from the throw line in a direction of being distant from the dart target may be recognized as the touch unit. Next, whether the touch unit is touched by the dart game player may be confirmed (1603). Next, when the touch unit is touched, whether the dart game is justly played may be authenticated (1604).

Next, when the touch unit is touched, at least some of the plurality of cameras may photograph at least a part of the dart game player or at least a part of the dart target (1605). Next, it may be authenticated that the dart game is justly played based on the photographed image (1606).

Those skilled in the art may understand that information and signals may be expressed by using predetermined various different technologies and schemes. For example, data, instructions, commands, information, signals, bits, symbols, and chips, which may be referred in the above description, may be expressed by voltages, currents, electromagnetic waves, magnetic fields or particles, optical fields or particles, or a predetermined combination thereof.

Those skilled in the art may understand that various illustrative logic blocks, modules, processors, means, circuits, and algorithm steps may be implemented by electronic hardware, various forms of programs or design codes (for example, referred to as "software" herein), or all of the combinations thereof. In order to clearly describe mutual compatibility of hardware and software, various illustrative components, blocks, modules, circuits, and steps have been generally described in the above in relation to the functions thereof. Whether the function may be implemented by hardware or software depends on design restrictions applied to a specific application and an entire system. Those skilled in the art may implement a function described by various methods for a specific application, but it should not be interpreted that the determinations of the implementation are beyond the scope of the present invention.

Various illustrative logic blocks, modules, and circuits described in relation to the exemplary embodiments disclosed herein may be implemented or performed through a general purpose process, a digital signal processor (DSP), an application-specific integrated circuit (ASIC), a field programmable gate array (FPGA), or another programmable logic device, a discrete gate or a transistor logic, or discrete hardware components, which are designed to perform functions described herein, or a predetermined combination thereof. The general purpose processor may be a microprocessor, and alternatively, the general purpose processor may be a predetermined existing processor, controller, microcontroller, or state machine. The processor may be implemented by a combination of computing devices, for example, a combination of a DSP and a micro-processor, micro-processors, one or more micro-processors connected with a DSP core, or other predetermined configuration.

It will be appreciated that a specific order or a layer structure of steps included in the suggested processes is an example of illustrative accesses. Based on design priorities, it will be appreciated that a specific order or a layer structure of steps included in the processes may be re-arranged within the scope of the present invention. The accompanying method claims provide various steps of elements in a sample order, but it does not mean that the method claims are limited to the suggested specific order or layer structure.

Steps of a method or an algorithm described in relation with the exemplary embodiments present herein may be directly implemented by hardware, a software module executed by a processor, or a combination thereof. The software module (for example, including executable commands and related data) and other data may be stored in a RAM memory, a flash memory, a ROM memory, an EPROM memory, an EEPROM memory, registers, a hard disc, a mobile disc, a CD-ROM, or a data memory (for example, a computer readable medium), such as a storage medium in a technically and publicly known predetermined form. The illustrative storage medium may be connected to a machine, such as a computer (for example, referable as a "processor") or a processor, and as a result, the processor may read information (for example, software commands) from the storage medium, and record information in the storage medium. The illustrative storage medium may be integrated into a processor. The processor and the storage medium may be included in an ASIC. The ASIC may be included in a user device. Alternatively, the processor and the storage medium may be included as separate components in a user device.

In one or more illustrative designs, described technologies may be implemented by hardware, software, firmware, or a combination thereof. When the illustrative design is implemented by software, functions may be stored in a computer readable medium, transmitted as one or more instructions through a computer readable medium, or coded in a computer readable medium. The computer readable medium includes a computer storage medium and a communication medium including a predetermined medium, which easily transmits a computer program from one place to another place. The storage medium may be a predetermined usable medium accessible by a general purpose or special purpose computer. For example, the computer readable medium may be accessed by a RAM, a ROM, an EEPROM, a CD-ROM, or other optical disc storages, a magnetic field disc storage, or other magnetic field storage devices, or a general or special purpose computer, or a general or special purpose processor, and include other predetermined media usable to carry or store a program code means demanded in a form of instructions or data structures, but is not limited thereto. Further, all of the connections are appropriately connected by the computer readable medium. For example, when the software is transmitted from a web site, a server, or another remote source by using wireless technologies, such as a coaxial cable, an optical fiber cable, a twist pair cable, a digital subscriber line (DSL), or infrared rays, wireless, and microwaves, the wireless technologies, such as a coaxial cable, an optical fiber cable, a twist pair cable, a digital subscriber line (DSL), or infrared rays, wireless, and microwaves, may be included in a definition of the medium. As used herein, the disk and the disc include a compact disc (CD), a laser disc, an optical disc, a DVD, a floppy disc, and a blue ray disc, and the discs optically reproduce data by laser, but the disks magnetically reproduce data in common Combinations of the aforementioned disc may also be included in the range of the computer readable medium.

Descriptions of the present exemplary embodiments are provided so that those skilled in the art may use or carry out the present invention. Various modifications of the exemplary embodiments may be apparent to those skilled in the art, general principles defined herein may be applied to other exemplary embodiments without departing from the scope of the present invention. Accordingly, the present invention is not limited to the exemplary embodiments present herein, but shall be interpreted within the broadest scope consistent with principles and new characteristics present herein.

The invention claimed is:

1. A dart game apparatus, comprising:

a throw line configured to indicate a position, at which a dart is thrown; and a touch unit extended from the throw line in an opposite direction of a dart target, wherein when a dart game player throws the dart in a state of touching the touch unit and based on a photographed image, it is authenticated that a dart game is justly performed; and a first camera configured to photograph at least a part of the dart game player, wherein when the dart game player touches the touch unit, the first camera starts photographing, and wherein a moving image photographed by the first camera is for a predetermined time section including a time point at which a dart game motion is generated.

2. The dart game apparatus of claim 1, wherein only when the dart game player throws the dart in a state of touching the touch unit, a dart score is admitted.

3. The dart game apparatus of claim 1, further comprising:

a second camera configured to photograph at least a part of the dart target, wherein when the dart game player touches the touch unit, the second camera starts photographing.

4. The dart game apparatus of claim 1, further comprising:

a memory configured to store at least a part of moving images photographed by the first and second cameras;

a network connection unit configured to transmit the moving image stored in the memory through a network; and a controller configured to control the first and second camera to photograph the moving image and the network connection unit to transmit the moving image to a server or other dart game apparatus though the network.

5. A dart game apparatus, comprising:

a dart target having a plurality of score areas;

a sensing unit configured to sense a hit of a dart; and a bottom part including lighting units, wherein some of the lighting units indicate a throw line, the throw line is indicated when the lighting unit indicating the throw line is turned on in the bottom part, and the throw line is not indicated when the lighting unit indicating the throw line is not turned on in the bottom part, the bottom part further includes a touch unit extended from the throw line in an opposite direction of the dart target, and when a dart game player throws the dart in a state of touching the touch unit and based on a photographed image, it is authenticated that a dart game is justly performed;

a first camera configured to photograph at least a part of the dart game plyer, wherein when the dart game player touches the touch unit, the first camera starts photographing, and wherein a moving image photographed by the first camera is for a predetermined time section including a time point at which a dart game motion is generated.

6. The dart game apparatus of claim 5, wherein only when the dart game player throws the dart in a state of touching the touch unit, a dart score is admitted.

7. The dart game apparatus of claim 5, further comprising:

a second camera configured to photograph at least a part of the dart target, wherein when the dart game player touches the touch unit, the second camera starts photographing.

8. The dart game apparatus of claim 5, wherein the lighting unit indicating the throw line is turned on when a dart game starts in the dart game apparatus.

9. The dart game apparatus of claim 5, further comprising:

a memory configured to store at least a part of moving images photographed by the first and second cameras;

a network connection unit configured to transmit the moving image stored in the memory through a network; and a controller configured to control the first and second camera to photograph the moving image and the network connection unit to transmit the moving image to a server or other dart game apparatus though the network.

10. A method of authenticating whether a dart game player justly participates in a dart game by a dart game apparatus, in which a remote multi-mode is available, the method comprising:

confirming whether a touch unit is touched by the dart game player; and when the touch unit is touched, starting to photograph, by at least some of a plurality of cameras, at least a part of the dart game player or at least a part of the dart target; and authenticating that the dart game is justly played when the touch unit is touched and based on the photographed image, wherein a moving image photographed by at least some of the plurality of cameras is for a predetermined time section including a time point at which a dart game motion is generated.

11. A method of authenticating whether a dart game player justly participates in a dart game by a dart game apparatus, in which a remote multi-mode is available, the method comprising:

indicating a throw line or a touch unit when the dart game apparatus starts;

recognizing, by the dart game player, the touch unit from the indicated throw line or the indicated touch unit;

confirming whether a touch unit is touched by the dart game player; and when the touch unit is touched, starting to photograph, by at least some of a plurality of cameras, at least a part of the dart game player or at least a part of the dart target; and authenticating that the dart game is justly played when the touch unit is touched and based on the photographed image, wherein a moving image photographed by at least some of the plurality of cameras is for a predetermined time section including a time point at which a dart game motion is generated.

12. A non-transitory computer readable recording medium for authenticating, by one or more computers, whether a dart game player justly participates in a dart game in a dart game apparatus, in which a remote multi-mode is available, the computer readable recording medium comprising:

a computer program code configured to cause at least one computer to confirm whether a touch unit is touched by the dart game player;

the computer program code configured to cause at least one computer to photograph at least a part of the dart game player or at least a part of the dart target through at least some of a plurality of cameras when the touch unit is touched; and the computer program code configured to cause at least one computer to authenticate that the dart game is justly played when the touch unit is touched and based on the photographed image, wherein a moving image photographed by at least some of the plurality of cameras is for a predetermined time section including a time point at which a dart game motion is generated.

* * * * *